US011194260B2

(12) United States Patent
Ochi et al.

(10) Patent No.: US 11,194,260 B2
(45) Date of Patent: Dec. 7, 2021

(54) WHITE TONER

(71) Applicant: CANON KABUSHIKI KAISHA, Tokyo (JP)

(72) Inventors: Kouichirou Ochi, Chiba (JP); Hayato Ida, Toride (JP); Yuya Chimoto, Funabashi (JP); Katsuyuki Hotta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/872,145

(22) Filed: May 11, 2020

(65) Prior Publication Data

US 2020/0363747 A1 Nov. 19, 2020

(30) Foreign Application Priority Data

May 15, 2019 (JP) ..... JP2019-091955
Mar. 17, 2020 (JP) ..... JP2020-046332

(51) Int. Cl.
*G03G 9/087* (2006.01)
*G03G 9/09* (2006.01)

(52) U.S. Cl.
CPC ..... *G03G 9/08755* (2013.01); *G03G 9/0902* (2013.01)

(58) Field of Classification Search
None
See application file for complete search history.

(56) References Cited

U.S. PATENT DOCUMENTS

2013/0330522 A1* 12/2013 Suzuki ..... G03G 9/081
428/195.1

FOREIGN PATENT DOCUMENTS

| | | | | |
|---|---|---|---|---|
| EP | 2626745 | A1 * | 8/2013 | ..... G03G 9/087 |
| JP | 2000-56514 | A | 2/2000 | |
| JP | 2012-177763 | A | 9/2012 | |

* cited by examiner

*Primary Examiner* — Peter L Vajda
(74) *Attorney, Agent, or Firm* — Canon U.S.A., Inc., IP Division

(57) ABSTRACT

A white toner including toner particles each of which contains a binder resin and a white pigment whose content is 20 to 80 mass % or less, wherein the binder resin contains a polymer A having a first and a second monomer unit, wherein the content of the first monomer unit is 5.0 to 60.0 mol % with respect to the total number of moles of all monomer units in the polymer A, wherein the content of the second monomer unit is 20.0 to 95.0 mol % with respect to the total number of moles of all the monomer units in the polymer A, wherein the SP value of the first monomer unit and the SP value of the second monomer unit satisfy specific relations, and wherein the white pigment has a total amount of a surface acidic group amount and a surface basic group amount of 60 μmol/g or more.

12 Claims, No Drawings

WHITE TONER

BACKGROUND OF THE INVENTION

Field of the Invention

The present disclosure relates to a white toner to be used in an electrophotographic image-forming method.

Description of the Related Art

In recent years, a toner that can correspond to various media has been demanded along with the development of an image-forming apparatus, such as a copying machine or a printer. Under such circumstances, a technology involving providing printed matter having a high added value through the use of a special color toner, such as a transparent toner or a white toner, has been developed.

The white toner is important for forming a white image on colored paper or a transparent film, and a toner using a high-refractive index material, such as titanium oxide, has been developed for achieving a high concealing property (Japanese Patent Application Laid-Open No. 2000-56514). In addition, a white toner using a crystalline resin has been developed (Japanese Patent Application Laid-Open No. 2012-177763).

In normal cases, in order to form a white image with the white toner and to represent a sufficient white color, the color of a base is preferably concealed so as to be incapable of being recognized. Such concealing property of the image is expressed by the scattering of light in an image film, and hence a pigment to be used in the white toner is required to satisfy the following: the pigment itself is colorless; and a difference in refractive index between the pigment and a binder resin is large, that is, the pigment is a material having a high refractive index. In addition, in order to express a sufficient concealing property in the white toner, such white pigment as described above is preferably incorporated into the toner in an amount larger than that of a pigment for any other color and with satisfactory dispersibility.

However, it has been found that when a white pigment, such as titanium oxide, is incorporated in a large amount into a toner, the bending resistance of a fixed image may reduce owing to an increase in area of an interface between a binder resin having a small interaction and the white pigment. With regard to the disadvantage, the use of a high-molecular weight resin containing a large amount of a crosslinking component can improve the bending resistance. However, the use has involved a disadvantage in that the viscosity of the toner increases, and hence its low-temperature fixability becomes insufficient.

In addition, even when a crystalline resin is used, the strength of the image has been insufficient in some cases, though the resin contributes to the low-temperature fixability.

SUMMARY OF THE INVENTION

In view of such disadvantages, an aspect of the present disclosure is to provide a white toner that is excellent in concealing property as a white toner, and that is also excellent in bending resistance and low-temperature fixability.

The inventors of the present disclosure have made extensive investigations, and as a result, have found that the above-mentioned disadvantages can be solved by incorporating a resin having a specific structure and a white pigment having an acid-base amount (total amount of a surface acidic group amount and a surface basic group amount) of 60 μmol/g or more into a toner particle.

That is, according to one aspect of the present disclosure, there is provided a white toner including toner particles each containing a binder resin and a white pigment, wherein the toner particles contain 20 mass % or more and 80 mass % or less of the white pigment, wherein the binder resin contains a polymer A having a first monomer unit represented by the following formula (A-1) and a second monomer unit different from the first monomer unit:

Formula (A-1)

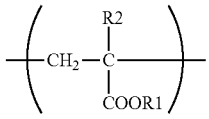

in the formula (A-1), R1 represents an alkyl group having 18 to 36 carbon atoms, and R2 represents a hydrogen atom or a methyl group, wherein a content of the first monomer unit in the polymer A is from 5.0 mol % to 60.0 mol % with respect to a total number of moles of all monomer units in the polymer A, wherein a content of the second monomer unit in the polymer A is from 20.0 mol % to 95.0 mol % with respect to the total number of moles of all the monomer units in the polymer A, wherein when an SP value of the first monomer unit is represented by $SP_{11}$ $(J/cm^3)^{0.5}$ and an SP value of the second monomer unit is represented by $SP_{21}$ $(J/cm^3)^{0.5}$, the $SP_{11}$ and the $SP_{21}$ satisfy the following expression (1) and the following expression (2): $3.00 \leq (SP_{21}-SP_{11}) \leq 25.00$ . . . (1); and $21.00 \leq SP_{21}$ . . . (2), and wherein the white pigment has a total amount of a surface acidic group amount and a surface basic group amount of 60 μmol/g or more.

According to another aspect of the present disclosure, there is provided a white toner including toner particles each containing a binder resin and a white pigment, wherein the toner particles contain 20 mass % or more and 80 mass % or less of the white pigment, wherein the binder resin contains a polymer B of a composition containing a first polymerizable monomer and a second polymerizable monomer different from the first polymerizable monomer, wherein the first polymerizable monomer is represented by the following formula (A-2):

Formula (A-2)

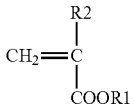

in the formula (A-2), R1 represents an alkyl group having 18 to 36 carbon atoms, and R2 represents a hydrogen atom or a methyl group, wherein a content of the first polymerizable monomer in the composition is from 5.0 mol % to 60.0 mol % with respect to a total number of moles of all polymerizable monomers in the composition, wherein a content of the second polymerizable monomer in the composition is from 20.0 mol % to 95.0 mol % with respect to the total number of moles of all the polymerizable monomers in the composition, wherein when an SP value of the first polymerizable monomer is represented by $SP_{12}$ $(J/cm^3)^{0.5}$ and an SP value of the second polymerizable monomer is represented by $SP_{22}$ $(J/cm^3)^{0.5}$, the $SP_{12}$ and the $SP_{22}$ satisfy the following expression (3) and the following expression (4): $0.60 \leq (SP_{22}-SP_{12}) \leq 15.00$ . . . (3); and $18.30 \leq SP_{22}$ . . . (4), and wherein the white pigment has a total amount of a surface acidic group amount and a surface basic group amount of 60 μmol/g or more.

Further features of the present disclosure will become apparent from the following description of exemplary embodiments.

DESCRIPTION OF THE EMBODIMENTS

In at least one embodiment of the present disclosure, the description "○○ or more and ×× or less" or "from ○○ to ××" representing a numerical range means a numerical range including a lower limit and an upper limit that are end points unless otherwise stated.

In at least one embodiment of the present disclosure, the term "(meth)acrylic acid ester" means an acrylic acid ester and/or a methacrylic acid ester.

In at least one embodiment of the present disclosure, the term "monomer unit" is defined as follows: in a polymer, one carbon-carbon bond in a main chain obtained by the polymerization of a vinyl-based monomer is one unit. The vinyl-based monomer may be represented by the following formula (Z):

(Z)

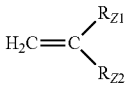

in the formula (Z), $R_{Z1}$ represents a hydrogen atom or an alkyl group, and $R_{Z2}$ represents an arbitrary substituent.

The inventors of the present disclosure have considered the mechanism via which the effects of the present disclosure are expressed to be as described below.

When a polymer A to be incorporated into a toner has a first monomer unit represented by the following formula (A-1):

Formula (A-1)

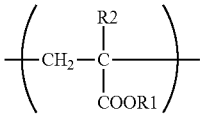

in the formula (A-1), R1 represents an alkyl group having 18 to 36 carbon atoms, and R2 represents a hydrogen atom or a methyl group, and a second monomer unit different from the first monomer unit, and the monomer units have a certain SP value difference, the monomer units form a phase-separated state without being compatible with each other. In addition, when the second monomer unit has an SP value of 21.00 $(J/cm^3)^{0.5}$ or more, and such second monomer unit and a white pigment having a total amount of a surface acidic group amount and a surface basic group amount of 60 μmol/g or more are combined with each other, both of the unit and the pigment are hydrophilic and hence have high affinities for each other. Accordingly, the second monomer unit is unevenly distributed to the surface of the white pigment in the toner. Meanwhile, the first monomer unit has a long-chain alkyl moiety, and hence easily forms a crystal structure. A region in which the second monomer unit is unevenly distributed and a crystal region formed by the first monomer unit are formed between the particles of the white pigment. Probably as a result of the foregoing, the strength of the entirety of a fixed film is improved, and hence the bending resistance of a fixed image is improved.

The inventors have assumed that even when a polymer B is used instead of the polymer A, the effects of the present disclosure are expressed via the same mechanism.

Details about at least one embodiment of the present disclosure are described below.

<Polymer A/Polymer B>

In a first aspect of the present disclosure, a white toner includes the polymer A having the first monomer unit represented by the formula (A-1) and the second monomer unit different from the first monomer unit.

In addition, when the SP value of the first monomer unit is represented by $SP_{11}$ $(J/cm^3)^{0.5}$ and the SP value of the second monomer unit is represented by $SP_{21}$ $(J/cm^3)^{0.5}$, the $SP_{11}$ and the $SP_{21}$ satisfy the following expression (1) and the following expression (2).

$$3.00 \leq (SP_{21}-SP_{11}) \leq 25.00 \quad (1)$$

$$21.00 \leq SP_{21} \quad (2)$$

In addition, in a second aspect of the present disclosure, the white toner includes the polymer (polymer B) of a composition containing a first polymerizable monomer represented by the following formula (A-2) and a second polymerizable monomer different from the first polymerizable monomer:

Formula (A-2)

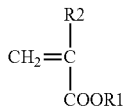

in the formula (A-2), R1 represents an alkyl group having 18 to 36 carbon atoms, and R2 represents a hydrogen atom or a methyl group.

In addition, when the SP value of the first polymerizable monomer is represented by $SP_{12}$ $(J/cm^3)^{0.5}$ and the SP value of the second polymerizable monomer is represented by $SP_{22}$ $(J/cm^3)^{0.5}$, the $SP_{12}$ and the $SP_{22}$ satisfy the following expression (3) and the following expression (4).

$$0.60 \leq (SP_{22}-SP_{12}) \leq 15.00 \quad (3)$$

$$18.30 \leq SP_{22} \quad (4)$$

When the first monomer unit to be incorporated into the polymer A has an alkyl group having 18 to 36 carbon atoms, the polymer A has crystallinity, and hence the low-temperature fixability of the white toner is improved. Further, when the crystal moiety of the polymer continuously forms a network structure between the particles of the white pigment, the strength of a fixed film after the fixation of an image is improved, and hence the bending resistance of the fixed image is improved.

Although the unit of an SP value in at least one embodiment of the present disclosure is $(J/cm^3)^{0.5}$, the unit may be converted into the unit of $(cal/cm^3)^{0.5}$ by using the equation "1 $(cal/cm^3)^{0.5}$=2.045 $(J/cm^3)^{0.5}$".

A case in which the SP value difference specified by the expression (1) or the expression (3) is satisfied is preferred because a reduction in crystallinity of the polymer A or the polymer B can be suppressed, and hence both of the low-temperature fixability and heat-resistant storage stability of the white toner are achieved.

In the first aspect, the content of the first monomer unit in the polymer A is from 5.0 mol % to 60.0 mol % with respect to the total number of moles of all monomer units in the polymer A, and the content of the second monomer unit in the polymer A is from 20.0 mol % to 95.0 mol % with respect to the total number of moles of all the monomer units in the polymer A.

In addition, in the second aspect, the content of the first polymerizable monomer in the composition is from 5.0 mol % to 60.0 mol % with respect to the total number of moles of all polymerizable monomers in the composition, and the content of the second polymerizable monomer in the composition is from 20.0 mol % to 95.0 mol % with respect to the total number of moles of all the polymerizable monomers in the composition.

When the content of the first monomer unit or the content of the first polymerizable monomer falls within the above-mentioned range, the white toner exhibits a sharp-melt property and hence obtains excellent low-temperature fixability. In addition, the network of the crystal becomes moderate, and hence satisfactory bending resistance is obtained.

A polymerizable monomer producing the first monomer unit in the first aspect (the same holds true for the first polymerizable monomer in the second aspect) is selected from the group consisting of (meth)acrylic acid esters each having an alkyl group having 18 to 36 carbon atoms.

Examples of the polymerizable monomer include (meth) acrylic acid esters each having a linear alkyl group having 18 to 36 carbon atoms, such as stearyl (meth)acrylate, nonadecyl (meth)acrylate, eicosyl (meth)acrylate, heneicosanyl (meth)acrylate, behenyl (meth)acrylate, lignoceryl (meth) acrylate, ceryl (meth)acrylate, octacosyl (meth)acrylate, myricyl (meth)acrylate, and dotriacontyl (meth)acrylate; and (meth)acrylic acid esters each having a branched alkyl group having 18 to 36 carbon atoms, such as 2-decyltetradecyl (meth)acrylate.

Those polymerizable monomers may be used alone or in combination thereof.

For example, the following polymerizable monomers may each be used as the second polymerizable monomer forming the second monomer unit. The second polymerizable monomers may be used alone or in combination thereof.

Monomer having a nitrile group
Monomer having a hydroxy group
Monomer having an amide group
Vinyl ester
Monomer having a urethane group
Monomer having a urea group
Monomer having a carboxy group Examples of the monomer having a nitrile group include acrylonitrile and methacrylonitrile.

Examples of the monomer having a hydroxy group include 2-hydroxyethyl (meth)acrylate and 2-hydroxypropyl (meth)acrylate.

Examples of the monomer having an amide group include acrylamide, and a monomer obtained by causing an amine having 1 to 30 carbon atoms and a carboxylic acid having an ethylenically unsaturated bond and having 2 to 30 carbon atoms (e.g., acrylic acid or methacrylic acid) to react with each other by a known method. Examples of the vinyl ester include vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate, and vinyl octoate.

Examples of the monomer having a urethane group include: a monomer obtained by causing an alcohol having an ethylenically unsaturated bond and having 2 to 22 carbon atoms and an isocyanate having 1 to 30 carbon atoms to react with each other by a known method; and a monomer obtained by causing an alcohol having 1 to 26 carbon atoms and an isocyanate having an ethylenically unsaturated bond and having 2 to 30 carbon atoms to react with each other by a known method.

Examples of the alcohol having an ethylenically unsaturated bond and having 2 to 22 carbon atoms include 2-hydroxyethyl methacrylate and vinyl alcohol.

Examples of the isocyanate having 1 to 30 carbon atoms include a monoisocyanate compound, an aliphatic diisocyanate compound, an alicyclic diisocyanate compound, and an aromatic diisocyanate compound.

Examples of the monoisocyanate compound include: benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, and 2,6-dipropylphenyl isocyanate.

Examples of the aliphatic diisocyanate compound include trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, and 2,4,4-trimethylhexamethylene diisocyanate.

Examples of the alicyclic diisocyanate compound include 1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, and hydrogenated tetramethylxylylene diisocyanate.

Examples of the aromatic diisocyanate compound include phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate, and xylylene diisocyanate.

Examples of the alcohol having 1 to 26 carbon atoms include methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, and erucyl alcohol.

Examples of the isocyanate having an ethylenically unsaturated bond and having 2 to 30 carbon atoms include 2-isocyanatoethyl (meth)acrylate, 2-(0-[1'-methylpropylideneamino]carboxyamino)ethyl (meth)acrylate, 2-[(3,5-dimethylpyrazolyl)carbonylamino]ethyl (meth)acrylate, and 1,1-(bis(meth)acryloyloxymethyl)ethylisocyanate.

An example of the monomer having a urea group is a monomer obtained by causing an amine having 3 to 22 carbon atoms and an isocyanate having an ethylenically unsaturated bond and having 2 to 30 carbon atoms to react with each other by a known method.

Examples of the amine having 3 to 22 carbon atoms include primary amines (e.g., n-butylamine, t-butylamine, propylamine, and isopropylamine), secondary amines (e.g., di-n-ethylamine, di-n-propylamine, and di-n-butylamine), aniline, and cyclohexylamine.

Examples of the isocyanate having an ethylenically unsaturated bond and having 2 to 30 carbon atoms are as described above.

Examples of the monomer having a carboxy group include methacrylic acid, acrylic acid, and 2-carboxyethyl (meth)acrylate.

Of those, each of the vinyl esters is a non-conjugated monomer, and hence its reactivity with the first polymerizable monomer is easily kept moderate. Accordingly, each of the vinyl esters easily improves the crystallinity of the polymer A or the polymer B. Of the vinyl esters, vinyl acetate is particularly preferred because both of the low-temperature fixability and the bending resistance can be achieved at a higher level.

It is preferred that the second monomer unit be at least one selected from the group consisting of a structure represented by the following formula (B-1) and a structure represented by the following formula (C-1):

Formula (B-1)

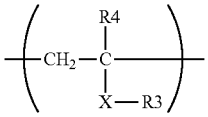

in the formula (B-1), X represents a single bond or an alkylene group having 1 to 6 carbon atoms, R3 represents any one functional group selected from the group consisting of (i) —C≡N, (ii) —C(═O)NHR15, where R15 represents a hydrogen atom or an alkyl group having 1 to 4 carbon atoms, (iii) a hydroxy group, (iv) —COOR16, where R16 represents a hydrogen atom, an alkyl group having 1 to 6 carbon atoms, or a hydroxyalkyl group having 1 to 6 carbon atoms, (v) —NHCOOR17, where R17 represents an alkyl group having 1 to 4 carbon atoms, (vi) —NH—C(═O)—$NH(R18)_2$, where R18s each independently represent a hydrogen atom or an alkyl group having 1 to 6 carbon atoms, (vii) —$COO(CH_2)_2NHCOOR19$, where R19 represents an alkyl group having 1 to 4 carbon atoms, and (viii) —$COO(CH_2)_2$—NH—C(═O)—$NH(R20)_2$, where R20s each independently represent a hydrogen atom or an alkyl group having 1 to 6 carbon atoms, and R4 represents a hydrogen atom or a methyl group;

Formula (C-1)

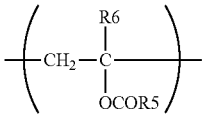

in the formula (C-1), R5 represents an alkyl group having 1 to 4 carbon atoms, and R6 represents a hydrogen atom or a methyl group.

It is preferred that the polymerizable monomer producing the second monomer unit be at least one selected from the group consisting of a polymerizable monomer represented by the following formula (B-2) and a polymerizable monomer represented by the following formula (C-2):

Formula (B-2)

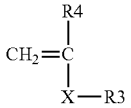

in the formula (B-2), X represents a single bond or an alkylene group having 1 to 6 carbon atoms, R3 represents any one functional group selected from the group consisting of (i) —C≡N, (ii) —C(═O)NHR15, where R15 represents a hydrogen atom or an alkyl group having 1 to 4 carbon atoms, (iii) a hydroxy group, (iv) —COOR16, where R16 represents a hydrogen atom, an alkyl group having 1 to 6 carbon atoms, or a hydroxyalkyl group having 1 to 6 carbon atoms, (v) —NHCOOR17, where R17 represents an alkyl group having 1 to 4 carbon atoms, (vi) —NH—C(═O)—$NH(R18)_2$, where R18s each independently represent a hydrogen atom or an alkyl group having 1 to 6 carbon atoms, (vii) —$COO(CH_2)_2NHCOOR19$, where R19 represents an alkyl group having 1 to 4 carbon atoms, and (viii) —$COO(CH_2)_2$—NH—C(═O)—$NH(R20)_2$, where R20s each independently represent a hydrogen atom or an alkyl group having 1 to 6 carbon atoms, and R4 represents a hydrogen atom or a methyl group;

Formula (C-2)

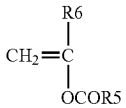

in the formula (C-2), R5 represents an alkyl group having 1 to 4 carbon atoms, and R6 represents a hydrogen atom or a methyl group.

When a plurality of kinds of monomer units each satisfying the requirements of the first monomer unit are present in the polymer A, the value of the $SP_{11}$ in the expression (1) is the weighted average of the SP values of the respective monomer units.

For example, an SP value ($SP_{11}$) when the polymer A contains A mol % of a monomer unit A having an SP value of $SP_{111}$ with respect to the total number of moles of monomer units each satisfying the requirements of the first monomer unit, and contains (100-A) mol % of a monomer unit B having an SP value of $SP_{112}$ with respect to the total number of moles of the monomer units each satisfying the requirements of the first monomer unit is calculated from the following equation.

$$SP_{11}=(SP_{111}\times A+SP_{112}\times(100-A))/100$$

Also when the polymer A contains three or more monomer units each satisfying the requirements of the first monomer unit, the $SP_{11}$ is similarly calculated.

In addition, all monomer units each having an $SP_{21}$ that satisfies the expression (1) with respect to the $SP_{11}$ calculated by the above-mentioned method and that satisfies the expression (2) correspond to the second monomer unit.

That is, when the second polymerizable monomer is two or more kinds of polymerizable monomers, the $SP_{21}$ represents the SP value of a monomer unit derived from each polymerizable monomer, and the difference $SP_{21}-SP_{11}$ is determined for the monomer unit derived from each of the second polymerizable monomers.

The polymer A may contain a third monomer unit that does not satisfy the specifications concerning the first and second monomer units.

In addition, the composition concerning the polymer B may contain a third polymerizable monomer that does not satisfy the specifications concerning the first and second polymerizable monomers.

In addition, the following monomer free of a nitrile group, an amide group, a urethane group, a hydroxy group, a urea group, or a carboxy group as described above may also be used: for example, styrene and derivatives thereof, such as styrene and o-methylstyrene, and (meth)acrylic acid esters, such as n-butyl (meth)acrylate, t-butyl (meth)acrylate, and 2-ethylhexyl (meth)acrylate.

When a unit formed by the reaction of any such monomer satisfies the expression (1), the unit serves as the second monomer unit. In addition, when any such monomer satisfies the expression (3), the monomer serves as the second polymerizable monomer.

As the third monomer, styrene and methyl (meth)acrylate are preferred.

It is preferred that the third monomer unit be a monomer unit represented by the following formula (D-1) or the following formula (D-2):

Formula (D-1)

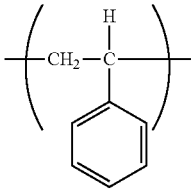

Formula (D-2)

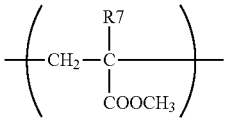

in the formula (D-2), R7 represents a hydrogen atom or a methyl group.

From the viewpoint of making it easier to obtain the effects of the present disclosure, in particular, the low-temperature fixability, the content of the polymer A or the polymer B is preferably 60 mass % or more with respect to the total mass of the binder resin of the white toner. The content is more preferably 70 mass % or more, still more preferably 80 mass % or more.

In addition, the toner may include any other resin. Examples of the other resin include the following resins: homopolymers of styrene and substituted products thereof, such as polystyrene, poly-p-chlorostyrene, and polyvinyltoluene; styrene-based copolymers, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer; and polyvinyl chloride, a phenol resin, a natural resin-modified phenol resin, a natural resin-modified maleic acid resin, an acrylic resin, a methacrylic resin, polyvinyl acetate, a silicone resin, a polyester resin, a polyurethane resin, a polyamide resin, a furan resin, an epoxy resin, a xylene resin, polyvinylbutyral, a terpene resin, a coumarone-indene resin, and a petroleum-based resin.

Of those, a styrene-based copolymer or a polyester resin is preferred. In addition, the other resin is preferably amorphous.

<White Pigment>

The toner particles of the white toner contain white pigment particles. The term "white pigment" as used herein refers to achromatic particles.

Examples of the white pigment include titanium oxide, magnesium oxide, aluminum oxide, zinc oxide, barium sulfate, calcium carbonate, calcium titanate, strontium titanate, silica, clay, and talc. Those white pigments may be surface-treated particles, or may be surface-untreated particles.

Of those, titanium oxide and calcium titanate are preferred because each of titanium oxide and calcium titanate has a high refractive index, and as a result, improves the concealing property of the white toner.

The white pigment is incorporated at from 20 mass % to 80 mass % into the toner particles. The content is preferably from 30 mass % to 70 mass %, more preferably from 40 mass % to 60 mass %. When the content falls within the range, at the time of the use of the toner particles as a white toner, a sufficient whiteness degree can be obtained without the impairment of the chargeability of the toner.

The white pigment has an acidic group and a basic group on the surface of each of its particles. The total of the surface acidic group amount and surface basic group amount of the white pigment is 60 μmol/g or more. When the white pigment has, on its surface, an acidic group and a basic group whose total amount falls within the range, the surface becomes more hydrophilic, and hence the second monomer unit moiety of the polymer A can be unevenly distributed to the surface of the white pigment.

The surface acidic group amount and surface basic group amount of the white pigment may be controlled by changing the kinds of the parent particles of the white pigment, or by changing the kind or treatment amount of a surface treatment agent for the pigment. For example, the following compounds may each be used as the surface treatment agent. A treatment agent for controlling the surface acidic group amount may be, for example, trimethylolethane, and a treatment agent for controlling the surface basic group amount may be, for example, trimethanolamine acetate.

<Release Agent>

The toner may include a release agent as required. Examples of the release agent include: low-molecular-weight polyolefins, such as polyethylene; silicones each having a melting point (softening point) through heating; fatty acid amides, such as oleamide, erucamide, ricinoleamide, and stearamide; ester waxes, such as stearyl stearate; plant-based waxes, such as carnauba wax, rice wax, candelilla wax, Japan wax, and jojoba oil; animal-based waxes, such as beeswax; mineral or petroleum-based waxes, such as montan wax, ozokerite, ceresin, paraffin wax, microcrystalline wax, Fischer-Tropsch wax, and ester wax; and modified products thereof.

The content of the release agent is preferably 1 part by mass or more and 25 parts by mass or less with respect to 100 parts by mass of the binder resin.

The melting point of the release agent is preferably 50° C. or more and 100° C. or less, more preferably 70° C. or more and 100° C. or less.

<Charge Control Agent>

A charge control agent may be incorporated into the toner as required. Although a known charge control agent may be utilized as the charge control agent to be incorporated into the toner, a metal compound of an aromatic carboxylic acid is particularly preferred because the compound is colorless, increases the charging speed of the toner, and can stably hold a constant charge quantity. A negative charge control agent is, for example, any one of the following compounds: a salicylic acid metal compound; a naphthoic acid metal compound; a dicarboxylic acid metal compound; a polymer-type compound having a sulfonic acid or a carboxylic acid in a side chain thereof; a polymer-type compound having a sulfonate or a sulfonic acid esterified product in a side chain thereof; a polymer-type compound having a carboxylate or a carboxylic acid esterified product in a side chain thereof; a boron compound; a urea compound; a silicon compound; and a calixarene.

The charge control agent may be internally added to each of the toner particles, or may be externally added thereto.

The content of the charge control agent is preferably from 0.2 part by mass to 10 parts by mass with respect to 100 parts by mass of the binder resin.

<External Additive>

An external additive may be incorporated into the toner as required. Inorganic fine particles (inorganic fine powder) each made of silica, titanium oxide, aluminum oxide, or the like are preferred as the external additive. The inorganic fine particles are preferably hydrophobized with a hydrophobizing agent, such as a silane compound, a silicone oil, or a mixture thereof.

An external additive for improving the fluidity of the toner is preferably inorganic fine particles having a specific surface area of 50 $m^2/g$ or more and 400 $m^2/g$ or less, and an external additive for improving the durability thereof is preferably inorganic fine particles having a specific surface area of 10 $m^2/g$ or more and 50 $m^2/g$ or less. Inorganic fine particles having specific surface areas in the ranges may be used in combination for improving the fluidity of the toner and improving the durability thereof.

The external additive is preferably used in an amount of 0.1 part by mass or more and 10.0 parts by mass or less with respect to 100 parts by mass of the toner particles. A known mixer, such as a Henschel mixer, may be used in the mixing of the toner particles and the external additive.

<Developer>

The toner, which may be used as a one-component developer, is preferably used as a two-component developer by being mixed with a magnetic carrier for further improving its dot reproducibility. In this case, a stable image is obtained over a long time period.

A generally known magnetic carrier may be used as the magnetic carrier. Examples thereof include the following materials: surface-oxidized iron powder or unoxidized iron powder; particles of metals, such as iron, lithium, calcium, magnesium, nickel, copper, zinc, cobalt, manganese, chromium, and a rare earth, particles each made of an alloy thereof, and particles each made of an oxide thereof; a magnetic material, such as ferrite; and a magnetic material-dispersed resin carrier (so-called resin carrier) containing a magnetic material and a binder resin holding the magnetic material under a state in which the magnetic material is dispersed therein.

When the toner is used as a two-component developer by being mixed with the magnetic carrier, a mixing ratio between the toner and the carrier at the time is preferably 2 mass % or more and 15 mass % or less, more preferably 4 mass % or more and 13 mass % or less in terms of toner concentration in the two-component developer.

<Method of Producing Toner Particles>

A method of producing the toner particles is not particularly limited, and a conventionally known production method, such as a suspension polymerization method, an emulsion aggregation method, a melt kneading method, or a dissolution suspension method, may be adopted.

The resultant toner particles may be used as they are as a toner. In addition, a toner may be obtained by mixing the resultant toner particles with inorganic fine particles, and as required, any other external additive. A mixing apparatus that may be used in the mixing of the toner particles, the inorganic fine particles, and the other external additive is, for example, any one of the following apparatus: a double cone mixer, a V-type mixer, a drum-type mixer, a super mixer, a Henschel mixer, a Nauta mixer, MECHANO HYBRID (manufactured by Nippon Coke & Engineering Co., Ltd.), and NOBILTA (manufactured by Hosokawa Micron Corporation).

The external additive is preferably used in an amount of 0.1 part by mass or more and 10.0 parts by mass or less with respect to 100 parts by mass of the toner particles.

An example of a toner production procedure based on a pulverization method is described below.

In a raw material-mixing step, predetermined amounts of, for example, a binder resin including an amorphous polyester resin, a wax, a colorant, and as required, any other component, such as a charge control agent, serving as materials forming the toner particles are weighed, and the materials are blended and mixed. A mixing apparatus is, for example, a double cone mixer, a V-type mixer, a drum-type mixer, a super mixer, a Henschel mixer, a Nauta mixer, or MECHANO HYBRID (manufactured by Nippon Coke & Engineering Co., Ltd.).

Next, the mixed materials are melt-kneaded to disperse the wax and the like in the binder resin. In the melt-kneading step, a batch-type kneader, such as a pressure kneader or a Banbury mixer, or a continuous kneader may be used, and a single-screw or twin-screw extruder has been in the mainstream because of the following superiority: the extruder can perform continuous production. Examples thereof include a KTK-type twin-screw extruder (manufactured by Kobe Steel, Ltd.), a TEM-type twin-screw extruder (manufactured by Toshiba Machine Co., Ltd.), a PCM kneader (manufactured by Ikegai Ironworks Corp), a twin-screw extruder (manufactured by K.C.K.), a co-kneader (manufactured by Buss), and KNEADEX (manufactured by Nippon Coke & Engineering Co., Ltd.). Further, a resin composition obtained by the melt-kneading may be rolled with a twin-roll mill or the like, and may be cooled with water or the like in a cooling step.

Next, the cooled product of the resin composition is pulverized into a desired particle diameter in a pulverizing step. In the pulverizing step, the cooled product is coarsely pulverized with a pulverizer, and is then finely pulverized with a fine pulverizer. Examples of the pulverizer include a crusher, a hammer mill, and a feather mill. Examples of the fine pulverizer include KRYPTRON SYSTEM (manufactured by Kawasaki Heavy Industries, Ltd.), SUPER ROTOR (manufactured by Nisshin Engineering Inc.), TURBO MILL (manufactured by Turbo Kogyo Co., Ltd.), and a fine pulverizer based on an air jet system.

After that, the finely pulverized product is classified with a classifier or a sifter as required to provide a classified product (toner particles). Examples of the classifier and the sifter include the following apparatus: ELBOW-JET (manufactured by Nittetsu Mining Co., Ltd.) based on an inertial classification system, and TURBOPLEX (manufactured by Hosokawa Micron Corporation), TSP SEPARATOR (manufactured by Hosokawa Micron Corporation), and FACULTY (manufactured by Hosokawa Micron Corporation) based on a centrifugal force classification system.

Of those, FACULTY (manufactured by Hosokawa Micron Corporation) is preferred in terms of an improvement in transfer efficiency because the apparatus can perform the spheroidizing treatment of the toner particles simultaneously with their classification.

In addition, the surface treatment of the toner particles, such as a spheroidizing treatment, may be performed after the pulverization as required. An apparatus to be used in the surface treatment is, for example, any one of the following apparatus: HYBRIDIZATION SYSTEM (manufactured by Nara Machinery Co., Ltd.), MECHANOFUSION SYSTEM (manufactured by Hosokawa Micron Corporation), FACULTY (manufactured by Hosokawa Micron Corporation), and METEORAINBOW MR TYPE (manufactured by Nippon Pneumatic Mfg. Co., Ltd.).

Further, the surfaces of the toner particles are subjected to an external addition treatment with an external additive, such as inorganic fine particles, as required. A method for the external addition treatment is, for example, a method including blending predetermined amounts of the toner particles and any one of various known external additives, and stirring and mixing the materials with a mixing apparatus. Examples of the mixing apparatus include a double cone mixer, a V-type mixer, a drum-type mixer, a super mixer, a Henschel mixer, a Nauta mixer, MECHANO HYBRID (manufactured by Nippon Coke & Engineering Co., Ltd.), and NOBILTA (manufactured by Hosokawa Micron Corporation).

Methods of measuring physical properties related to at least one embodiment of the present disclosure are described below.

<Method of Measuring Content of Each Monomer Unit in Polymer A or Polymer B>

The content of each monomer unit in the polymer A (or the polymer B) is measured by $^{1}$H-NMR under the following conditions.

Measuring apparatus: A FT NMR apparatus JNM-EX400 (manufactured by JEOL Ltd.)
Measurement frequency: 400 MHz
Pulse condition: 5.0 μs
Frequency range: 10,500 Hz
Number of scans: 64 times
Measurement temperature: 30° C.
Sample: 50 Milligrams of a measurement sample is loaded into a sample tube having an inner diameter of 5 mm, and deuterated chloroform ($CDCl_3$) is added as a solvent to the tube. The sample is dissolved in the solvent in a thermostat at 40° C. to prepare a solution.

The content of each monomer unit in the polymer A (or the polymer B) is calculated as described below.

In the resultant $^{1}$H-NMR chart, a peak independent of a peak assigned to a constituent for any other monomer unit is selected from peaks assigned to constituents for the first monomer unit, and the integrated value S1 of the peak is calculated.

Similarly, in the resultant $^{1}$H-NMR chart, a peak independent of a peak assigned to a constituent for any other monomer unit is selected from peaks assigned to constituents for the second monomer unit, and the integrated value S2 of the peak is calculated.

Further, when the third monomer unit is present, a peak independent of a peak assigned to a constituent for any other monomer unit is selected from peaks assigned to constituents for the third monomer unit, and the integrated value S3 of the peak is calculated.

The content of the first monomer unit is determined by using the integrated values S1, S2, and S3 as described below. n1, n2, and n3 each represent the number of hydrogen atoms in the constituent to which the peak to which attention has been paid for the corresponding moiety is assigned.

$$\text{Content (mol \%) of first monomer unit}=\{(S1/n1)/((S1/n1)+(S2/n2)+(S3/n3))\}\times 100$$

Similarly, the content of the second or third monomer unit is determined as described below.

$$\text{Content (mol \%) of second monomer unit}=\{(S2/n2)/((S1/n1)+(S2/n2)+(S3/n3))\}\times 100$$

$$\text{Content (mol \%) of third monomer unit}=\{(S3/n3)/((S1/n1)+(S2/n2)+(S3/n3))\}\times 100$$

When a polymerizable monomer in which a constituent except a vinyl group is free of any hydrogen atom is used in the polymer A, the measurement is performed by using $^{13}$C-NMR through the use of $^{13}$C as a measurement atomic nucleus in a single-pulse mode, and the content is similarly calculated by $^{1}$H-NMR.

In addition, peaks assigned to the release agent and any other resin may overlap each other to preclude the observation of an independent peak. Thus, there occurs a case in which the contents of the monomer units derived from the various polymerizable monomers in the polymer A cannot be calculated. In that case, analysis may be performed by: producing a polymer A' in accordance with the same method without the use of the release agent and the other resin; and regarding the resultant polymer A' as the polymer A.

<Method of Calculating SP Value>

The $SP_{12}$ or the $SP_{22}$ is determined in accordance with a calculation method proposed by Fedors as described below. The same holds true for an $SP_{32}$ when the third polymerizable monomer is used.

The evaporation energy (Δei) (cal/mol) and molar volume (Δvi) ($cm^3$/mol) of each atom or atomic group in the molecular structure of each polymerizable monomer are determined from a table shown in "Polym. Eng. Sci., 14(2), 147-154 (1974)". Then, an SP value is calculated by using the following equation.

$$SP \text{ value } (J/cm^3)^{0.5}=(4.184\times\Sigma\Delta ei/\Sigma\Delta vi)^{0.5}$$

The $SP_{11}$ or the $SP_{21}$ is calculated by the same calculation method as that described above for an atom or an atomic group of a molecular structure in a state in which the double bond of the polymerizable monomer is cleaved by its polymerization. The same holds true for an $SP_{31}$ when the third monomer unit is present.

<Measurement of Content of White Pigment in Toner Particles>

The white pigment is separated from the toner particles, from which the external additive has been separated by a method to be described later, with a solvent, such as toluene, and its amount is measured.

<Measurement of Surface Acidic Group Amount of White Pigment>

The white pigment is added to a 0.01 mol/L solution of potassium hydroxide in ethanol. Next, the potentiometric titration of the supernatant of the mixture is performed with a potentiometric automatic titration apparatus (AT-510, manufactured by Kyoto Electronics Manufacturing Co., Ltd.) and a 0.01 mol/L solution of hydrochloric acid in ethanol. Then, the surface acidic group amount of the white pigment is determined from a difference between the amount of hydrochloric acid required for the neutralization of the supernatant and the amount of potassium hydroxide that is originally present.

(When Surface Acidic Group Amount of White Pigment is Measured from Toner)

First, the external additive is separated from the toner particles.

160 Grams of sucrose (manufactured by Kishida Chemical Co., Ltd.) is added to 100 mL of ion-exchanged water, and is dissolved therein while being heated in a water bath, thereby preparing a sucrose thick liquid.

31 Grams of the sucrose thick liquid and 6 mL of CONTAMINON N (10 mass % aqueous solution of a neutral detergent for washing a precision measuring device, the solution being formed of a nonionic surfactant, an anionic surfactant, and an organic builder, and having a pH of 7, manufactured by Wako Pure Chemical Industries, Ltd.) are loaded into a tube for centrifugal separation to produce a dispersion liquid.

1.0 Gram of the toner is added to the dispersion liquid, and the block of the toner is loosened with a spatula or the like.

Next, the tube for centrifugal separation is shaken with a shaker. After the shaking, the solution is transferred to a glass tube for a swing rotor (50 mL), and is separated with a centrifugal separator under the conditions of 3,500 rpm and 30 minutes. The toner particles and the detached external additive are separated from each other by the operation.

It is visually observed that the toner particles and the aqueous solution are sufficiently separated from each other, followed by the collection of the toner particles. The particles are filtered with a vacuum filter, and are then dried with a dryer for 1 hour or more to provide toner particles from which the external additive has been separated.

Further, the soluble matter of the resultant toner particles except the white pigment is dissolved in tetrahydrofuran, toluene, hexane, and the like. The solution is filtered, and the filtration residue is then redispersed in water, followed by the recovery of the white pigment through the removal of the remaining external additive by centrifugal separation. The surface acidic group amount is calculated in accordance with the above-mentioned measurement method.

<Measurement of Surface Basic Group Amount of White Pigment>

The white pigment is added to a 0.01 mol/L solution of hydrochloric acid in ethanol. The mixture is treated with an ultrasonic wave at 25° C. for 1 hour, and is centrifuged to provide a supernatant. Next, the potentiometric titration of the supernatant is performed with a potentiometric automatic titration apparatus (AT-510, manufactured by Kyoto Electronics Manufacturing Co., Ltd.) and a 0.01 mol/L solution of potassium hydroxide in ethanol. The surface basic group amount of the white pigment is determined from a difference between the amount of potassium hydroxide required for the titration of only the 0.01 mol/L solution of hydrochloric acid in ethanol and the amount of potassium hydroxide required for the titration of the supernatant.

(When Surface Basic Group Amount of White Pigment is Measured from Toner)

In accordance with the measurement of the surface acidic group amount described above, the white pigment is separated from the toner, and then its surface basic group amount is determined by the above-mentioned measurement method.

EXAMPLES

The present disclosure is described in more detail below by way of Examples and Comparative Examples. However, the present disclosure is by no means limited to the examples. In the following formulation, the term "part(s)" is on a mass basis unless otherwise stated. Construction conditions for respective toner particles are shown in Table 1.

Production Example A1 of Polymer A

| | |
|---|---|
| Solvent: toluene | 100.0 parts |
| Monomer composition (The monomer composition is a composition obtained by mixing behenyl acrylate, vinyl acetate, and styrene described below at the following ratio.) | 100.0 parts |
| Behenyl acrylate (first polymerizable monomer) | 60.0 parts (26.2 mol %) |
| Vinyl acetate (second polymerizable monomer) | 30.0 parts (57.9 mol %) |
| Styrene (third polymerizable monomer) | 10.0 parts (15.9 mol %) |
| Polymerization initiator: t-butyl peroxypivalate (PERBUTYL PV, manufactured by NOF Corporation) | 0.5 part |

Under a nitrogen atmosphere, the above-mentioned materials were loaded into a reaction vessel including a reflux condenser, a stirring machine, a temperature gauge, and a nitrogen-introducing tube. While the materials in the reaction vessel were stirred at 200 rpm, the materials were heated to 70° C. and subjected to a polymerization reaction for 12 hours. Thus, such a dissolved liquid that the polymer of a monomer composition was dissolved in toluene was obtained. Subsequently, the temperature of the dissolved liquid was reduced to 25° C., and then the dissolved liquid was loaded into 1,000.0 parts of methanol while methanol was stirred. Thus, methanol-insoluble matter was precipitated. The resultant methanol-insoluble matter was separated by filtration, and was washed with methanol, followed by vacuum drying at 40° C. for 24 hours. Thus, a polymer A1 was obtained. The resultant polymer A1 is a polymer satisfying the specifications concerning the polymer B in the second aspect.

The NMR analysis of the polymer A1 found that the polymer contained 26.2 mol % of a monomer unit derived from behenyl acrylate, 57.9 mol % of a monomer unit derived from vinyl acetate, and 15.9 mol % of a monomer unit derived from styrene.

The contents (mol %) of the respective polymerizable monomers in the polymer A1 and the contents (mol %) of the respective monomer units in the polymer A1 were equal to each other.

The SP values of the monomers and the monomer units were calculated. The physical properties are shown in Table 2 and Table 3. The SP values are represented in the unit of $(cal/cm^3)^{0.5}$.

Production Examples A2 to A18 of Polymers A

Synthesis was performed in the same manner as in Production Example A1 of Polymer A except that the respective monomers and their numbers of parts by mass were changed as shown in Table 1. Thus, polymers A2 to A18 were obtained. The physical properties are shown in Tables 2 and 3.

The contents (mol %) of the respective monomer units in each of the polymers A2 to A18 were equal to ratios (mol %) in formulation shown in Table 1. The polymers A2 to A11 are polymers each satisfying the specifications concerning the polymer B in the second aspect.

Monomer names in Table 1 to Table 3 are as described below.

| | |
|---|---|
| BEA: behenyl acrylate | $CH_2{=}CH{-}COO{-}(CH_2)_{21}CH_3$ |
| SA: stearyl acrylate | $CH_2{=}CH{-}COO{-}(CH_2)_{17}CH_3$ |

-continued

| | |
|---|---|
| MYA: myricyl acrylate | $CH_2{=}CH{-}COO{-}(CH_2)_{29}CH_3$ |
| HA: hexadecyl acrylate | $CH_2{=}CH{-}COO{-}(CH_2)_{15}CH_3$ |
| VA: vinyl acetate | |
| MN: methacrylonitrile | |
| HPMA: hydroxypropyl methacrylamide | |
| MA: methacrylic acid | |
| AM: acrylamide | |
| St: styrene | |
| MM: methyl methacrylate | |

TABLE 1

| | First polymerizable monomer | | | Second polymerizable monomer | | | Third polymerizable monomer | | |
|---|---|---|---|---|---|---|---|---|---|
| Polymer A | Kind | mass % | mol % | Kind | mass % | mol % | Kind | mass % | mol % |
| A1 | BEA | 60.0 | 26.2 | VA | 30.0 | 57.9 | St | 10.0 | 15.9 |
| A2 | BEA | 67.0 | 28.9 | MN | 22.0 | 53.8 | St | 11.0 | 17.3 |
| A3 | BEA | 50.0 | 26.0 | HPMA | 40.0 | 55.0 | St | 10.0 | 19.0 |
| A4 | BEA | 60.0 | 26.2 | MA | 30.0 | 57.9 | St | 10.0 | 15.9 |
| A5 | BEA | 65.0 | 27.6 | AM | 25.0 | 56.9 | St | 10.0 | 15.5 |
| A6 | BEA | 89.0 | 58.5 | MN | 11.0 | 41.2 | — | — | — |
| A7 | BEA | 40.0 | 10.5 | MN | 60.0 | 89.5 | — | — | — |
| A8 | BEA | 25.0 | 7.0 | VA | 75.0 | 93.0 | — | — | — |
| A9 | BEA | 61.0 | 27.5 | MN | 9.0 | 23.0 | St | 30.0 | 49.5 |
| A10 | SA | 67.0 | 32.3 | MN | 22.0 | 51.2 | St | 11.0 | 16.5 |
| A11 | MYA | 67.0 | 23.9 | MN | 22.0 | 57.6 | St | 11.0 | 18.5 |
| A12 | HA | 61.0 | 28.6 | MN | 26.0 | 54.0 | St | 13.0 | 17.4 |
| A13 | BEA | 90.0 | 61.3 | MN | 10.0 | 38.7 | — | — | — |
| A14 | BEA | 61.0 | 28.0 | MN | 7.0 | 18.2 | St | 11.0 | 16.5 |
| A15 | BEA | 60.0 | 28.5 | — | — | — | St | 11.0 | 19.1 |
| | | | | | | | MM | 29.0 | 52.4 |
| A16 | BEA | 20.0 | 4.8 | MN | 53.0 | 71.7 | St | 27.0 | 23.5 |
| A17 | BEA | 20.0 | 4.2 | MN | 80.0 | 95.8 | — | — | — |
| A18 | BEA | 15.0 | 4.3 | MN | 10.0 | 16.4 | St | 75.0 | 79.3 |

TABLE 2

| | First monomer unit | | Second monomer unit | | Third monomer unit | | |
|---|---|---|---|---|---|---|---|
| Polymer A | Original monomer | $SP_{11}$ | Original monomer | $SP_{21}$ | Original monomer | $SP_{31}$ | $SP_{21} - SP_{11}$ |
| A1 | BEA | 18.25 | VA | 21.60 | St | 20.11 | 3.35 |
| A2 | BEA | 18.25 | MN | 25.96 | St | 20.11 | 7.71 |
| A3 | BEA | 18.25 | HPMA | 24.12 | St | 20.11 | 5.87 |
| A4 | BEA | 18.25 | MA | 21.60 | St | 20.11 | 7.40 |
| A5 | BEA | 18.25 | AM | 39.25 | St | 20.11 | 21.00 |
| A6 | BEA | 18.25 | MN | 25.96 | — | — | 7.71 |
| A7 | BEA | 18.25 | MN | 25.96 | — | — | 7.71 |
| A8 | BEA | 18.25 | VA | 21.60 | — | — | 3.35 |
| A9 | BEA | 18.25 | MN | 25.96 | St | 20.11 | 7.71 |
| A10 | SA | 18.39 | MN | 25.96 | St | 20.11 | 7.57 |
| A11 | MYA | 18.08 | MN | 25.96 | St | 20.11 | 7.88 |
| A12 | HA | 18.47 | MN | 25.96 | St | 20.11 | 7.49 |
| A13 | BEA | 18.25 | MN | 25.96 | — | — | 7.71 |
| A14 | BEA | 18.25 | MN | 25.96 | St | 20.11 | 7.71 |
| A15 | BEA | 18.25 | — | — | St | 20.11 | — |
| | | | | | MM | 20.31 | |
| A16 | BEA | 18.25 | MN | 25.96 | St | 20.11 | 7.71 |
| A17 | BEA | 18.25 | MN | 25.96 | — | — | 7.71 |
| A18 | BEA | 18.25 | MN | 25.96 | St | 20.11 | 7.71 |

TABLE 3

| Polymer A | First polymerizable monomer Kind | First polymerizable monomer $SP_{12}$ | Second polymerizable monomer Kind | Second polymerizable monomer $SP_{22}$ | Third polymerizable monomer Kind | Third polymerizable monomer $SP_{32}$ | $SP_{22}$ − $SP_{12}$ |
|---|---|---|---|---|---|---|---|
| A1 | BEA | 17.69 | VA | 18.31 | St | 17.94 | 0.62 |
| A2 | BEA | 17.69 | MN | 21.97 | St | 17.94 | 4.28 |
| A3 | BEA | 17.69 | HPMA | 22.05 | St | 17.94 | 4.36 |
| A4 | BEA | 17.69 | MA | 21.95 | St | 17.94 | 4.26 |
| A5 | BEA | 17.69 | AM | 29.12 | St | 17.94 | 11.43 |
| A6 | BEA | 17.69 | MN | 21.97 | — | — | 4.28 |
| A7 | BEA | 17.69 | MN | 21.97 | — | — | 4.28 |
| A8 | BEA | 17.69 | VA | 18.31 | — | — | 0.62 |
| A9 | BEA | 17.69 | MN | 21.97 | St | 17.94 | 4.28 |
| A10 | SA | 17.71 | MN | 21.97 | St | 17.94 | 4.26 |
| A11 | MYA | 17.65 | MN | 21.97 | St | 17.94 | 4.32 |
| A12 | HA | 17.73 | MN | 21.97 | St | 17.94 | 4.24 |
| A13 | BEA | 17.69 | MN | 21.97 | — | — | 4.28 |
| A14 | BEA | 17.69 | MN | 21.97 | St | 17.94 | 4.28 |
| A15 | BEA | 17.69 | — | — | St<br>MM | 17.94<br>18.27 | — |
| A16 | BEA | 17.69 | MN | 21.97 | St | 17.94 | 4.28 |
| A17 | BEA | 17.69 | MN | 21.97 | — | — | 4.28 |
| A18 | BEA | 17.69 | MN | 21.97 | St | 17.94 | 4.28 |

Production Example of Titanium Oxide Particles 1

Titanium tetraisopropoxide was used as a raw material, and an extremely small amount of the raw material was fed a plurality of times from a chemical pump to the glass wool of a vaporizer, which had been heated to about 200° C., by using a nitrogen gas as a carrier gas so that the raw material was evaporated. Then, the vapor was instantaneously decomposed by heating at about 300° C. in a reactor, and was then rapidly cooled, followed by the collection of a product. The product was further calcined at about 300° C. for about 2 hours to provide titanium oxide.

Further, 3 mass % of aluminum hydroxide was added to titanium oxide thus obtained, and the mixture was filtered and washed to provide a titanium oxide cake. 2 mass % of trimethylolethane was added to the titanium oxide cake, and the mixture was pulverized with a jet mill to provide surface-treated titanium oxide particles 1, that is, such titanium oxide particles 1 that part of hydroxy groups on their surfaces were condensed with part of the hydroxy groups of trimethylolethane.

The resultant titanium oxide particles 1 had a surface acidic group amount of 43 μmol/g and a surface basic group amount of 28 μmol/g.

Production Example of Titanium Oxide Particles 2

Titanium oxide particles 2 were obtained in the same manner as in Production Example of Titanium Oxide Particles 1 except that in Production Example of Titanium Oxide Particles 1, the amount of aluminum hydroxide was changed to 5 mass %, and the amount of trimethylolethane was changed to 3 mass %.

The resultant titanium oxide particles 2 had a surface acidic group amount of 39 μmol/g and a surface basic group amount of 23 μmol/g.

Production Example of Titanium Oxide Particles 3

Titanium oxide particles 3 were obtained in the same manner as in Production Example of Titanium Oxide Particles 1 except that in Production Example of Titanium Oxide Particles 1, the amount of aluminum hydroxide was changed to 6 mass %, and the amount of trimethylolethane was changed to 4 mass %.

The resultant titanium oxide particles 3 had a surface acidic group amount of 27 μmol/g and a surface basic group amount of 25 μmol/g.

Production Example of Calcium Titanate Particles 1

Titanium tetraisopropoxide was used as a raw material, and an extremely small amount of the raw material was fed a plurality of times from a chemical pump to the glass wool of a vaporizer, which had been heated to about 200° C., by using a nitrogen gas as a carrier gas so that the raw material was evaporated. Then, the vapor was instantaneously decomposed by heating at about 300° C. in a reactor, and was then rapidly cooled, followed by the collection of a product. The product was further calcined at about 300° C. for about 2 hours and pulverized with a jet mill to provide titanium oxide.

52 Parts of titanium oxide described above and 48 parts of calcium carbonate were dispersed in 100 parts of water and mixed with each other well. The mixture was thermally treated at a temperature of about 1,000° C. to provide calcium titanate particles 1.

The resultant calcium titanate particles 1 had a surface acidic group amount of 55 μmol/g and a surface basic group amount of 76 μmol/g.

Example 1

The following materials were prepared.

| | |
|---|---|
| Polymer A1: | 36 parts |
| Polyester resin 1: [Composition (mol %) [polyoxypropylene(2.2)-2,2-bis(4-hydroxyphenyl)propane:polyoxyethylene(2.2)-2,2-bis(4-hydroxyphenyl)propane:terephthalic acid:dodecylsuccinic acid:trimellitic acid = 80:20:75:10:15], Mw = 152,000] | 9 parts |
| Titanium oxide particles 1: (rutile type, volume-average particle diameter: 250 nm, total amount of the surface acidic group amount and the surface basic group amount: 71 μmol/g) | 50.0 parts |
| Fischer-Tropsch wax (melting point: 78° C.): | 5.0 parts |

The above-mentioned materials were mixed with a Henschel mixer (MODEL FM-75, manufactured by Mitsui Mining Co., Ltd.) at a number of revolutions of 20 $s^{-1}$ for a revolution time of 5 minutes. After that, the mixture was kneaded with a biaxial kneader (MODEL PCM-30, manufactured by Ikegai Corp) set to a temperature of 130° C. The resultant kneaded product was cooled to 25° C., and was coarsely pulverized with a hammer mill into 1 mm or less to provide a coarsely pulverized product. The resultant coarsely pulverized product was finely pulverized with a mechanical pulverizer (T-250, manufactured by Turbo Kogyo Co., Ltd.). Further, the finely pulverized product was classified with FACULTY F-300 (manufactured by Hosokawa Micron Corporation) to provide toner particles 1.

100 Parts of the resultant toner particles 1 were dry-mixed with 1.5 parts of hydrophobic-treated silica fine powder whose primary particles had a number-average diameter of 10 nm and 2.5 parts of hydrophobic-treated silica fine powder whose primary particles had a number-average diameter of 100 nm by using a Henschel mixer (manufactured by Mitsui Mining Co., Ltd.). Thus, a toner 1 was obtained. The toner 1 had a median diameter on a volume basis of 6.5 μm.

Examples 2 to 17 and Comparative Examples 1 to 8

Production was performed in the same manner as in Example 1 except that the used materials and their numbers of parts by mass were changed to those shown in Table 4. Thus, toners 2 to 17 for Examples and toners 18 to 25 for Comparative Examples were obtained.

The following evaluation tests were performed by using the respective toners. The evaluation results are shown in Table 5.

TABLE 4

| | | Formulation | | | | | | | | | | | |
|---|---|---|---|---|---|---|---|---|---|---|---|---|---|
| | | Binder resin | | | | | White pigment | | | | | Wax | |
| | | Polymer A | | Other resins | | | | | Surface acidic | Surface basic | Total of surface acidic group amount and surface basic | | |
| | Toner | Kind | Part(s) by mass | Kind | Part(s) by mass | Ratio of Polymer A | Kind | Part(s) by mass | group amount (μmol/g) | group amount (μmol/g) | group amount (μmol/g) | Kind | Part(s) by mass |
| Example 1 | 1 | A1 | 36.0 | Polyester resin 1 | 9.0 | 80% | Titanium oxide particles 1 | 50 | 43 | 28 | 71 | Fischer-Tropsch wax | 5 |
| Example 2 | 2 | A1 | 32.0 | Polyester resin 1 | 8.0 | 80% | Calcium titanate particles 1 | 55 | 55 | 76 | 131 | | 5 |
| Example 3 | 3 | A1 | 28.4 | Polyester resin 1 | 16.7 | 63% | Titanium oxide particles 1 | 50 | 43 | 28 | 71 | | 5 |
| Example 4 | 4 | A1 | 24.8 | Polyester resin 1 | 20.3 | 55% | Titanium oxide particles 1 | 50 | 43 | 28 | 71 | | 5 |
| Example 5 | 5 | A2 | 24.8 | Polyester resin 1 | 20.3 | 55% | Titanium oxide particles 1 | 50 | 43 | 28 | 71 | | 5 |
| Example 6 | 6 | A3 | 24.8 | Polyester resin 1 | 20.3 | 55% | Titanium oxide particles 1 | 50 | 43 | 28 | 71 | | 5 |
| Example 7 | 7 | A4 | 24.8 | Polyester resin 1 | 20.3 | 55% | Titanium oxide particles 1 | 50 | 43 | 28 | 71 | | 5 |
| Example 8 | 8 | A5 | 24.8 | Polyester resin 1 | 20.3 | 55% | Titanium oxide particles 1 | 50 | 43 | 28 | 71 | | 5 |
| Example 9 | 9 | A2 | 24.8 | Polyester resin 1 | 20.3 | 55% | Titanium oxide particles 2 | 50 | 39 | 23 | 62 | | 5 |
| Example 10 | 10 | A6 | 24.8 | Polyester resin 1 | 20.3 | 55% | Titanium oxide particles 1 | 50 | 43 | 28 | 71 | | 5 |
| Example 11 | 11 | A7 | 24.8 | Polyester resin 1 | 20.3 | 55% | Titanium oxide particles 1 | 50 | 43 | 28 | 71 | | 5 |
| Example 12 | 12 | A8 | 24.8 | Polyester resin 1 | 20.3 | 55% | Titanium oxide particles 1 | 50 | 43 | 28 | 71 | | 5 |
| Example 13 | 13 | A9 | 24.8 | Polyester resin 1 | 20.3 | 55% | Titanium oxide particles 1 | 50 | 43 | 28 | 71 | | 5 |
| Example 14 | 14 | A2 | 40.2 | Polyester resin 1 | 32.9 | 55% | Titanium oxide particles 1 | 22 | 43 | 28 | 71 | | 5 |
| Example 15 | 15 | A2 | 11.0 | Polyester resin 1 | 9.0 | 55% | Titanium oxide particles 1 | 75 | 43 | 28 | 71 | | 5 |
| Example 16 | 16 | A10 | 24.8 | Polyester resin 1 | 20.3 | 55% | Titanium oxide particles 1 | 50 | 43 | 28 | 71 | | 5 |
| Example 17 | 17 | A11 | 24.8 | Polyester resin 1 | 20.3 | 55% | Titanium oxide particles 1 | 50 | 43 | 28 | 71 | | 5 |

TABLE 4-continued

| | | Formulation | | | | | | | | | | | |
|---|---|---|---|---|---|---|---|---|---|---|---|---|---|
| | | Binder resin | | | | | White pigment | | | | | Wax | |
| | | Polymer A | | Other resins | | | | | Surface acidic group amount (μmol/g) | Surface basic group amount (μmol/g) | Total of surface acidic group amount and surface basic group amount (μmol/g) | | |
| | Toner | Kind | Part(s) by mass | Kind | Part(s) by mass | Ratio of Polymer A | Kind | Part(s) by mass | | | | Kind | Part(s) by mass |
| Comparative Example 1 | 18 | A12 | 36.0 | Polyester resin 1 | 9.0 | 80% | Titanium oxide particles 1 | 50 | 43 | 28 | 71 | | 5 |
| Comparative Example 2 | 19 | A13 | 36.0 | Polyester resin 1 | 9.0 | 80% | Titanium oxide particles 1 | 50 | 43 | 28 | 71 | | 5 |
| Comparative Example 3 | 20 | A14 | 36.0 | Polyester resin 1 | 9.0 | 80% | Titanium oxide particles 1 | 50 | 43 | 28 | 71 | | 5 |
| Comparative Example 4 | 21 | A15 | 36.0 | Polyester resin 1 | 9.0 | 80% | Titanium oxide particles 1 | 50 | 43 | 28 | 71 | | 5 |
| Comparative Example 5 | 22 | A2 | 36.0 | Polyester resin 1 | 9.0 | 80% | Titanium oxide particles 3 | 50 | 27 | 25 | 52 | | 5 |
| Comparative Example 6 | 23 | A16 | 36.0 | Polyester resin 1 | 9.0 | 80% | Titanium oxide particles 1 | 50 | 43 | 28 | 71 | | 5 |
| Comparative Example 7 | 24 | A17 | 36.0 | Polyester resin 1 | 9.0 | 80% | Titanium oxide particles 1 | 50 | 43 | 28 | 71 | | 5 |
| Comparative Example 8 | 25 | A18 | 36.0 | Polyester resin 1 | 9.0 | 80% | Titanium oxide particles 3 | 50 | 27 | 25 | 52 | | 5 |

<Bending Resistance (Image Strength)>

Each of the toners and a ferrite carrier (volume-average particle diameter: 42 μm) whose surface had been coated with a silicone resin were mixed with each other so that a toner concentration became 8 mass %. Thus, a two-component developer was prepared. An unfixed toner image (solid image, 0.9 mg/cm$^2$) was formed on black paper (Nagatoya-shouten Co., Ltd., A4 paper, NA-3285) with the resultant two-component developer and a commercial full-color digital copying machine (CLC 1100, manufactured by Canon Inc.) from which a fixing unit had been removed. A fixing unit removed from a commercial full-color digital copying machine (imageRUNNER ADVANCE C5051, manufactured by Canon Inc.) was reconstructed so that its fixation temperature could be regulated. Under a room temperature of 15° C. and a humidity of 10%, the process speed was set to 357 mm/sec, and the unfixed image was fixed.

The fixed image at the highest fixable temperature (upper limit temperature at which no offset occurred) was bent crosswise, and was reciprocally rubbed with soft and thin paper (product name: "DUSPER", manufactured by Ozu Corporation) five times while a load of 4.9 kPa was applied thereto. Next, a 512-pixel square region in the cross portion was photographed with a CCD camera at a resolution of 800 pixels/inch. A threshold was set to 60%, and the image was binarized, followed by the measurement of the area ratio of a black portion that was a portion from which the toner had peeled. A smaller area ratio of the black portion means that the image is more excellent in bending resistance.

(Evaluation Criteria)

A: The area ratio of the black portion is less than 2.0%.

B: The area ratio of the black portion is 2.0% or more and less than 3.5%.

C: The area ratio of the black portion is 3.5% or more and less than 5.0%.

D: The area ratio of the black portion is 5.0% or more.

<Low-Temperature Fixability of Toner>

A full-color copying machine imagePRESS C800 manufactured by Canon Inc. was used as an image-forming apparatus. A two-component developer to be evaluated was loaded into the developing device for a cyan color of the image-forming apparatus, and was subjected to an evaluation to be described later.

The reconstruction points of the apparatus were as follows: a mechanism configured to discharge a magnetic carrier whose amount had become excessive in a developing device from the developing device was removed; and the fixation temperature was made freely changeable.

Conditions for the evaluation are described below.

Paper: Black paper (Nagatoya-shouten Co., Ltd., A4 paper, NA-3285)

Toner laid-on level on paper: 0.55 mg/cm$^2$ (The toner laid-on level was adjusted by a DC voltage VDC to be applied to a developer carrier, a charge potential VD of the surface of an electrostatic latent image-bearing member, and laser power)

Evaluation image: An image measuring 2 cm by 5 cm was arranged at the center of the A4 paper.

Test environment: A low-temperature and low-humidity environment: temperature 15° C./relative humidity 10% (hereinafter referred to as "L/L")

Process speed: 450 mm/sec

The fixation temperature was successively increased from 100° C. in increments of 5° C., and the lower limit temperature at which no offset occurred was defined as a fixation lower limit temperature. In the following evaluation criteria for the fixation lower limit temperature, a rank C or higher was judged to be satisfactory. The results are shown in Table 5.

(Evaluation Criteria for Fixation Lower Limit Temperature)

A: Less than 115° C.

B: 115° C. or more and less than 125° C.

C: 125° C. or more and less than 140° C.

D: 140° C. or more

<Whiteness Degree (Lightness L*)>

An unfixed image formed on black paper in the same manner as in the bending resistance evaluation was fixed with a fixing unit removed from a commercial full-color digital copying machine (imageRUNNER ADVANCE C5051, manufactured by Canon Inc.) at 150° C. The lightness L* of the resultant fixed image was measured with an X-Rite color reflection densitometer (500 SERIES: manufactured by X-Rite, Inc.), and was evaluated in accordance with the following criteria. In the following evaluation criteria for the whiteness degree, a rank C or higher was judged to be satisfactory. The evaluation results are shown in Table 5.

(Evaluation Criteria for Whiteness Degree)

A: The L* is 82 or more.

B: The L* is 78 or more and 81 or less.

C: The L* is 74 or more and 77 or less.

D: The L* is 73 or less.

TABLE 5

| | Image strength | | Low-temperature fixability | | Whiteness degree | |
|---|---|---|---|---|---|---|
| | Black portion ratio (%) | Rank | Fixation lower limit temperature (° C.) | Rank | Lightness L* | Rank |
| Example 1 | 1.8 | A | 111 | A | 83 | A |
| Example 2 | 1.9 | A | 113 | A | 83 | A |
| Example 3 | 2.4 | B | 113 | A | 82 | A |
| Example 4 | 2.8 | B | 118 | B | 82 | A |
| Example 5 | 3.7 | C | 119 | B | 82 | A |
| Example 6 | 3.8 | C | 120 | B | 82 | A |
| Example 7 | 4.0 | C | 120 | B | 82 | A |
| Example 8 | 4.1 | C | 128 | C | 82 | A |
| Example 9 | 4.3 | C | 122 | B | 82 | A |
| Example 10 | 4.4 | B | 129 | C | 82 | A |
| Example 11 | 4.5 | C | 136 | C | 82 | A |
| Example 12 | 4.6 | C | 138 | C | 82 | A |
| Example 13 | 4.7 | C | 128 | C | 82 | A |
| Example 14 | 2.6 | B | 114 | A | 75 | C |
| Example 15 | 4.5 | C | 138 | C | 86 | A |
| Example 16 | 4.3 | C | 124 | B | 82 | A |
| Example 17 | 4.8 | C | 133 | C | 82 | A |
| Comparative Example 1 | 5.8 | D | 114 | A | 82 | A |
| Comparative Example 2 | 2.9 | B | 148 | D | 82 | A |
| Comparative Example 3 | 4.2 | C | 145 | D | 82 | A |
| Comparative Example 4 | 6.1 | D | 121 | B | 82 | A |
| Comparative Example 5 | 7.2 | D | 122 | B | 82 | A |
| Comparative Example 6 | 5.6 | D | 148 | D | 82 | A |
| Comparative Example 7 | 5.7 | D | 149 | D | 82 | A |
| Comparative Example 8 | 5.6 | D | 150 | D | 82 | A |

According to at least one embodiment of the present disclosure, the white toner that is excellent in concealing property as a white toner, and that is also excellent in bending resistance and low-temperature fixability can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-091955, filed May 15, 2019, and Japanese Patent Application No. 2020-046332, filed Mar. 17, 2020, which are hereby incorporated by reference herein in their entirety.

What is claimed is:

1. A white toner comprising toner particles each containing a binder resin and a white pigment, wherein the toner particles contain 20 mass % or more and 80 mass % or less of the white pigment, wherein the binder resin contains a polymer A having a first monomer unit represented by the following formula (A-1) and a second monomer unit different from the first monomer unit:

Formula (A-1)

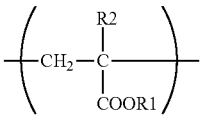

in the formula (A-1), R1 represents an alkyl group having 18 to 36 carbon atoms, and R2 represents a hydrogen atom or a methyl group, wherein a content of the first monomer unit in the polymer A is from 5.0 mol % to 60.0 mol % with respect to a total number of moles of all monomer units in the polymer A, wherein a content of the second monomer unit in the polymer A is from 20.0 mol % to 95.0 mol % with respect to the total number of moles of all the monomer units in the polymer A, the second monomer unit is at least one member selected from the group consisting of a structure represented by the following formula (B-1) and a structure represented by the following formula (C-1):

Formula (B-1)

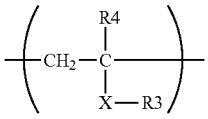

in the formula (B-1),

X represents a single bond or an alkylene group having 1 to 6 carbon atoms,

R3 represents any one functional group selected from the group consisting of (i) —C≡N, (ii) —C(=O)NHR15, where R15 represents a hydrogen atom or an alkyl group having 1 to 4 carbon atoms, (iii) a hydroxy group, (iv) —COOR16, where R16 represents a hydrogen atom, an alkyl group having 1 to 6 carbon atoms, or a hydroxyalkyl group having 1 to 6 carbon atoms, (v) —NHCOOR17, where R17 represents an alkyl group having 1 to 4 carbon atoms, (vi) —NH—C(=O)—NH(R18)$_2$ where each R18 independently represents a hydrogen atom or an alkyl group having 1 to 6 carbon atoms, (vii) —COO(CH$_2$)$_2$NHCOOR19, where R19 represents an alkyl group having 1 to 4 carbon atoms, and (viii) —COO(CH$_2$)$_2$—NH—C(=O)—NH(R20)$_2$, where each R20 independently represents a hydrogen atom or an alkyl group having 1 to 6 carbon atoms, and R4 represents a hydrogen atom or a methyl group;

Formula (C-1)

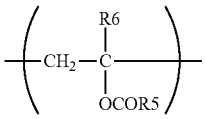

in the formula (C-1), R5 represents an alkyl group having 1 to 4 carbon atoms, and R6 represents a hydrogen atom or a methyl group, wherein when an SP value of the first monomer unit is represented by $SP_{11}$ (J/cm$^3$)$^{0.5}$ and an SP value of the second monomer unit is represented by $SP_{21}$ (J/cm$^3$)$^{0.5}$, the $SP_{11}$ and the $SP_{21}$ satisfy the following expression (1) and the following expression (2):

$$3.00 \leq (SP_{21} - SP_{11}) \leq 25.00 \quad (1); \text{ and}$$

$$21.00 \leq SP_{21} \quad (2), \text{ and}$$

wherein the white pigment has a total amount of a surface acidic group amount and a surface basic group amount of 60 μmol/g or more.

2. The white toner according to claim 1, wherein the second monomer unit is the structure represented by the formula (C-1).

3. The white toner according to claim 2, wherein in the formula (C-1), R5 represents a methyl group and R6 represents a hydrogen atom.

4. The white toner according to claim 1, wherein the polymer A has any monomer unit selected from the group consisting of a monomer unit represented by the following formula (D-1) and a monomer unit represented by the following formula (D-2) in addition to the first monomer unit and the second monomer unit:

Formula (D-1)

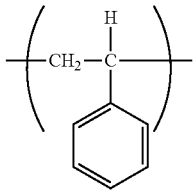

Formula (D-2)

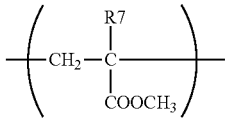

in the formula (D-2), R7 represents a hydrogen atom or a methyl group.

5. The white toner according to claim 1, wherein a content of the polymer A is 60 mass % or more with respect to a total mass of the binder resin.

6. The white toner according to claim 1, wherein the white pigment is one of titanium oxide and calcium titanate.

7. A white toner comprising toner particles each containing a binder resin and a white pigment, wherein the toner particles contain 20 mass % or more and 80 mass % or less of the white pigment, wherein the binder resin contains a polymer B that is a polymer of a composition containing a first polymerizable monomer and a second polymerizable monomer different from the first polymerizable monomer, wherein the first polymerizable monomer is a polymerizable monomer represented by the following formula (A-2):

Formula (A-2)

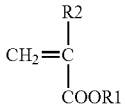

in the formula (A-2), R1 represents an alkyl group having 18 to 36 carbon atoms, and R2 represents a hydrogen atom or a methyl group, wherein a content of the first polymerizable monomer in the composition is from 5.0 mol % to 60.0 mol % with respect to a total number of moles of all polymerizable monomers in the composition, wherein a content of the second polymerizable monomer in the composition is from 20.0 mol % to 95.0 mol % with respect to the total number of moles of all the polymerizable monomers in the composition, the second polymerizable monomer is at least one selected from the group consisting of a polymerizable monomer represented by the following formula (B-2) and a polymerizable monomer represented by the following formula (C-2):

Formula (B-2)

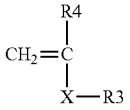

in the formula (B-2),

X represents a single bond or an alkylene group having 1 to 6 carbon atoms,

R3 represents any one functional group selected from the group consisting of (i) —C≡N, (ii) —C(═O)NHR15, where R15 represents a hydrogen atom or an alkyl group having 1 to 4 carbon atoms, (iii) a hydroxy group, (iv) —COOR16, where R16 represents a hydrogen atom, an alkyl group having 1 to 6 carbon atoms, or a hydroxyalkyl group having 1 to 6 carbon atoms, (v) —NHCOOR17, where R17 represents an alkyl group having 1 to 4 carbon atoms, (vi) —NH—C(═O)—NH(R18)$_2$ where each R18 independently represents a hydrogen atom or an alkyl group having 1 to 6 carbon atoms, (vii) —COO(CH$_2$)$_2$NHCOOR19, where R19 represents an alkyl group having 1 to 4 carbon atoms, and (viii) —COO(CH$_2$)$_2$—NH—C(═O)—NH(R20)$_2$, where each R20 independently represents a hydrogen atom or an alkyl group having 1 to 6 carbon atoms, and R4 represents a hydrogen atom or a methyl group;

Formula (C-2)

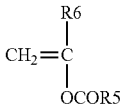

in the formula (C-2), R5 represents an alkyl group having 1 to 4 carbon atoms, and R6 represents a hydrogen atom or a methyl group, wherein when an SP value of the first polymerizable monomer is represented by $SP_{12}$ $(J/cm^3)^{0.5}$ and an SP value of the second polymerizable monomer is represented by $SP_{22}$ $(J/cm^3)^{0.5}$, the $SP_{12}$ and the $SP_{22}$ satisfy the following expression (3) and the following expression (4):

$$0.60 \leq (SP_{22} - SP_{12}) \leq 15.00 \quad (3); \text{ and}$$

$$18.30 \leq SP_{22} \quad (4), \text{ and}$$

wherein the white pigment has a total amount of a surface acidic group amount and a surface basic group amount of 60 μmol/g or more.

8. The white toner according to claim 7, wherein the second polymerizable monomer is the polymerizable monomer represented by the formula (C-2).

9. The white toner according to claim 8, wherein in the polymerizable monomer represented by the formula (C-2), R5 represents a methyl group and R6 represents a hydrogen atom.

10. The white toner according to claim 7, wherein the composition contains at least one polymerizable monomer selected from the group consisting of styrene, methyl methacrylate, and methyl acrylate in addition to the first polymerizable monomer and the second polymerizable monomer.

11. The white toner according to claim 7, wherein a content of the polymer B is 60 mass % or more with respect to a total mass of the binder resin.

12. The white toner according to claim 7, wherein the white pigment is one of titanium oxide and calcium titanate.

* * * * *